US009114603B2

(12) United States Patent
Smith

(10) Patent No.: US 9,114,603 B2
(45) Date of Patent: Aug. 25, 2015

(54) PROCESS FOR COLOR VARIABILITY IN PRINTING TO SIMULATE COLOR VARIATION OF NATURAL PRODUCT

(71) Applicant: PERGO (EUROPE) AB, Trelleborg (SE)

(72) Inventor: Patrick George Smith, Raleigh, NC (US)

(73) Assignee: PERGO (EUROPE) AB, Trelleborg (SE)

( * ) Notice: Subject to any disclaimer, the term of this patent is extended or adjusted under 35 U.S.C. 154(b) by 0 days.

(21) Appl. No.: 13/658,534

(22) Filed: Oct. 23, 2012

(65) Prior Publication Data

US 2013/0104757 A1 May 2, 2013

Related U.S. Application Data

(63) Continuation of application No. 12/054,032, filed on Mar. 24, 2008, now abandoned.

(60) Provisional application No. 60/907,320, filed on Mar. 28, 2007.

(51) Int. Cl.

| | |
|---|---|
| ***B05D 5/00*** | (2006.01) |
| ***B41F 31/07*** | (2006.01) |
| ***B41F 31/00*** | (2006.01) |
| ***B41M 1/10*** | (2006.01) |
| ***B41F 9/06*** | (2006.01) |
| ***B41F 31/04*** | (2006.01) |

(52) U.S. Cl.

CPC ..... *B41F 9/063* (2013.01); *B41F 31/00* (2013.01); *B41F 31/04* (2013.01); *B41M 1/10* (2013.01)

(58) Field of Classification Search

CPC ..... B41F 9/063; B41F 31/00; B41F 31/04; B41M 1/10

USPC ..... 101/170, 483, 485

See application file for complete search history.

(56) References Cited

U.S. PATENT DOCUMENTS

| | | | |
|---|---|---|---|
| 1,409,862 | A | 3/1922 | Jackson |
| 1,476,516 | A | 12/1923 | Jackson |
| 2,972,297 | A | 2/1961 | Auerbacher |

(Continued)

FOREIGN PATENT DOCUMENTS

| | | |
|---|---|---|
| DE | 4124565 | 1/1992 |
| DE | 20107876 | 10/2001 |

(Continued)

OTHER PUBLICATIONS

International Search Report dated Mar. 27, 2008.

(Continued)

*Primary Examiner* — Blake A Tankersley
*Assistant Examiner* — Marissa Ferguson Samreth
(74) *Attorney, Agent, or Firm* — Jenkins, Wilson, Taylor & Hunt, P.A.

(57) ABSTRACT

An apparatus for printing a variable pattern on a substrate, a method using the apparatus, a product produced by using the apparatus are disclosed. The apparatus includes an ink bath containing a printing agent to be applied to the substrate, a roller that picks up ink from the ink bath, a doctor blade to wipe of excess printing agent on the roller, and a means for intentionally varying the design printed on the substrate from the roller.

7 Claims, 3 Drawing Sheets

(56) References Cited

U.S. PATENT DOCUMENTS

| | | | | |
|---|---|---|---|---|
| 3,173,804 | A | 3/1965 | Ulrich | |
| 3,759,800 | A | 9/1973 | Reinke | |
| 3,810,774 | A | 5/1974 | Pittman | |
| 3,924,023 | A | 12/1975 | Boranian et al. | |
| 4,041,864 | A | 8/1977 | Dahlgren et al. | |
| 4,112,189 | A | 9/1978 | Terwilliger | |
| 4,612,074 | A | 9/1986 | Smith et al. | |
| 5,469,787 | A | 11/1995 | Turner et al. | |
| 6,022,152 | A | 2/2000 | Fassler et al. | |
| 6,461,676 | B2 | 10/2002 | Martino | |
| 6,465,046 | B1 | 10/2002 | Hansson et al. | |
| 6,565,761 | B1 | 5/2003 | Kesper | |
| 6,565,919 | B1 | 5/2003 | Hansson et al. | |
| 6,645,046 | B1 | 11/2003 | Vogtmann et al. | |
| 6,685,993 | B1 | 2/2004 | Hansson et al. | |
| 6,763,643 | B1 | 7/2004 | Martensson | |
| 6,779,453 | B2 * | 8/2004 | Samii | 101/485 |
| 6,823,638 | B2 | 11/2004 | Stanchfield | |
| 6,854,235 | B2 | 2/2005 | Martensson | |
| 6,888,147 | B1 | 5/2005 | Hansson et al. | |
| 6,991,830 | B1 | 1/2006 | Hansson et al. | |
| 7,003,364 | B1 | 2/2006 | Hansson et al. | |
| 7,188,774 | B2 * | 3/2007 | Pinchen et al. | 235/487 |
| 7,418,903 | B2 * | 9/2008 | Liang et al. | 101/486 |
| 8,561,534 | B2 * | 10/2013 | Fenzi | 101/36 |
| 8,564,534 | B2 * | 10/2013 | Leyvand et al. | 345/156 |
| 2003/0207083 | A1 | 11/2003 | Hansson | |
| 2005/0053767 | A1 | 3/2005 | Franco et al. | |
| 2005/0249929 | A1 | 11/2005 | Reichwein et al. | |
| 2007/0006543 | A1 | 1/2007 | Engstrom | |
| 2007/0137509 | A1 | 6/2007 | Fork | |
| 2008/0236431 | A1 | 10/2008 | Smith | |
| 2010/0285289 | A1 | 11/2010 | Nollet | |

FOREIGN PATENT DOCUMENTS

| | | |
|---|---|---|
| DE | 20317527 | 1/2004 |
| DE | 10361805 | 7/2005 |
| DE | 10 2006 024 571 | 8/2007 |
| EP | 2018680 | 10/1979 |
| EP | 0092593 | 11/1983 |
| EP | 0686509 | 12/1995 |
| EP | 0839667 | 5/1998 |
| EP | 1541373 | 6/2005 |
| EP | 1862304 | 12/2007 |
| EP | 1876017 | 1/2008 |
| EP | 1908608 | 4/2008 |
| EP | 1925461 | 5/2008 |
| EP | 1935642 | 6/2008 |
| EP | 2 134 477 | 5/2012 |
| NL | 7908764 | 7/1981 |
| SE | 9904781 | 6/2001 |
| WO | WO 91/06728 | 5/1991 |
| WO | WO 97/31775 | 9/1997 |
| WO | WO 97/31776 | 9/1997 |
| WO | WO 97/47834 | 12/1997 |
| WO | WO 01/48333 | 7/2001 |
| WO | WO 2004/108436 | 12/2004 |
| WO | WO 2006/002917 | 1/2006 |
| WO | WO 2006/043893 | 4/2006 |
| WO | WO 2008/074831 | 7/2006 |
| WO | WO 2007/076853 | 7/2007 |
| WO | WO 2008/121695 | 10/2008 |

OTHER PUBLICATIONS

Communication (Search Report) from the European Patent Office dated Aug. 5, 2010.

Non-Final Office Action for U.S. Appl. No. 12/054,032 dated Jun. 7, 2011.

Final Office Action for U.S. Appl. No. 12/054,032 dated Jan. 19, 2012.

Non-Final Office Action for U.S. Appl. No. 12/054,032 dated Jun. 20, 2012.

Final Office Action for U.S. Appl. No. 12/054,032 dated Dec. 12, 2012.

Advisory Action for U.S. Appl. No. 12/054,032 dated Feb. 27, 2013.

Non-Final Office Action for U.S. Appl. No. 12/054,032 dated Mar. 26, 2013.

* cited by examiner

PROCESS FOR COLOR VARIABILITY IN PRINTING TO SIMULATE COLOR VARIATION OF NATURAL PRODUCT

CROSS REFERENCE TO RELATED APPLICATIONS

This application is a continuation of and claims priority to U.S. patent application Ser. No. 12/054,032 filed Mar. 24, 2008, which claims priority to U.S. Provisional Application No. 60/907,320, filed Mar. 28, 2007, both of which are incorporated by reference herein in their entireties.

BACKGROUND

1. Field of the Invention

The invention is a method and device used in printing of images of natural, man-made materials/products, fantasy, animation, or indeed any design capable of human imagination which can be incorporated into rotogravure, digital, laser and other types of printing.

2. Background of the Invention

Printing of complex designs directly onto substrates or onto intermediate materials to be affixed to substrates can be performed by, e.g., rotogravure, digital and laser printing, wherein, often, a base coat or primer layer is applied, followed by applying the colors. These techniques allow for a substantial degree of specificity and exactness, permitting extremely complex patterns, designs and images to be reproduced from an original.

In conventional rotogravure printing, a structured roller or drum rotates through an ink bath. During rotation, the drum adsorbs the ink on the periphery of the drum, such that the ink coats, fills depressions and other structures on the surface. A doctor blade, an air blade, a manual wipe, etc. may be used to wipe excess ink off the drum. As a result, the ink is typically present only in the depressions and structures, and is not present on the curved outer surface of the drum. In a subsequent step, the drum is pressed against the printing surface, usually a paper, often by a counter roller, to transfer the ink in the depressions and structures to the paper. In transfer rotogravure printing, on the other hand, the ink is transferred from the drum to a transfer drum and then is transferred from the transfer drum to the substrate. These processes accurately recreate a first color of the pattern, design and images provided on the drum onto the paper. Conventionally, in order to add additional colors, a second drum and ink bath combination is used.

Rotogravure printing can be very inflexible with respect to creating variability due to dimensional constraints of the engraved, structured or textured drum. Examples of the inflexibility include lack of color variability and lack of dimensional flexibility, particularly in in-register designs.

In digital printing, the patterns, designs and images are provided in a digital format to the printing device. Typical digital information can be created by scanning or otherwise digitizing a natural or original image, such as a drawing or photograph. Other digital information can be created solely in a digital medium, e.g., by computer. In either case, the digital information can be manipulated to adjust any number of parameters or characteristics, such as size and color, such that the final printed image is not an exact recreation of the original. For example, should the original digitized image correspond to an area of 1 ft by 2 ft (i.e., a 1:2 length to width ratio), and the substrate has a length to width ratio of 1:4, the digitized image can be manipulated such that the digitized image fits the substrate. This can be accomplished by, e.g., cropping, zooming, non-uniform stretching, and uniform stretching.

In laser printing, a laser is aimed at a rotating polygonal mirror, which directs the laser beam through a system of lenses and mirrors onto a photoreceptor. As the beam sweeps across the photoreceptor, a stream of rasterized data held in memory turns the laser on and off to form the dots on the substrate. Lasers (now typically laser diodes) are often used because they generate a coherent beam of light for a high degree of accuracy. Where the laser beam strikes the photoreceptor, the charge is reversed, thus creating a latent electrical image on the photoreceptor surface. The surface with the latent image is then exposed to toner, i.e., fine particles of dry plastic powder mixed with carbon black or coloring agents. The charged toner particles are given a negative charge, and are electrostatically attracted to the photoreceptor where the laser wrote the latent image. Because like charges repel, the negatively charged toner will not touch the drum where light has not removed the negative charge.

The overall darkness of a laser printed image is controlled by the high voltage charge applied to the supply toner. Once the charged toner has jumped the gap to the surface of the drum, the negative charge on the toner itself repels the supply toner and prevents more toner from jumping to the drum. If the voltage is low, only a thin coal of toner is needed to stop more toner from transferring. If the voltage is high, then a thin coating on the drum is too weak to stop more toner from transferring to the drum. More supply toner will continue to jump to the drum until the charges on the drum are again high enough to repel the supply toner. At the darkest settings the supply toner voltage is high enough that it will also start coating the drum where the initial unwritten drum charge is still present, and will give the entire page a dark shadow. The photoreceptor is pressed or rolled over paper, transferring the image. Higher-end machines use a positively charged transfer roller on the back side of the paper to pull the toner from the photoreceptor to the paper. The paper passes through a fuser assembly with rollers that provide heat and pressure (up to 200 degrees Celsius), bonding the plastic toner powder to the paper.

In order to create multi-colored images with a laser printer, the different colored toners are often added by additional steps or passes, but in order to reduce misregistration between the colors, a large belt can be used to precisely add all the colors at the same time.

However, due to the nature of these and other conventional printing techniques, the produced designs, patterns and images are rigid. In other words, because conventional printing techniques reproduce the original with such a high degree of accuracy, such techniques do not allow for inherent variability in the final design.

SUMMARY OF THE INVENTION

By modifying the conventional printing techniques, It has become possible to incorporate inherent design variability while maintaining the overall desired patterns, designs and images. The present invention can be incorporated into printing techniques such as rotogravure, offset, flexography, relief printing, dye transfer, and digital printing (e.g., line, daisy wheel, dot matrix, heat transfer, blueprint, inkjet (such as bubble jet), foil making, screening, intaglio and lithography). Other types of digital printing are described by U.S. Pat. No. 6,645,046; No. 6,565,919; No. 6,685,993; No. 6,888,147; No. 7,003,364 (each of which is incorporated by reference in its entirety). Each printed design contains at least slight, irreproducible, random variations intentionally incorporated within the design.

In one embodiment, instead of each colorant, e.g., ink bath, consisting of a single homogenous color, the colorant can be a heterogeneous blend of two or more colors. In a preferred embodiment, the various colors are part of immiscible inks, such that the colors are prohibited from blending. Accordingly, when the print head or drum draws material from the ink bath, every draw can be slightly different.

In another embodiment, differing contact pressures can be used to create a variable dosing scheme. By adjusting contact pressure between the various structures, color intensity can be adjusted.

In a further embodiment, cylinders used to form the base coat or primer layer can be interchangeable.

In a still further embodiment, anon-synchronized print or base color can be applied either beneath or within synchronized designs.

The printing techniques of the invention can be used in the printing of paper, parts or panels either as a finished product or for use as a base (raw) material to be converted or manufactured into other products.

DETAILED DESCRIPTION OF THE INVENTION

Figure 1:
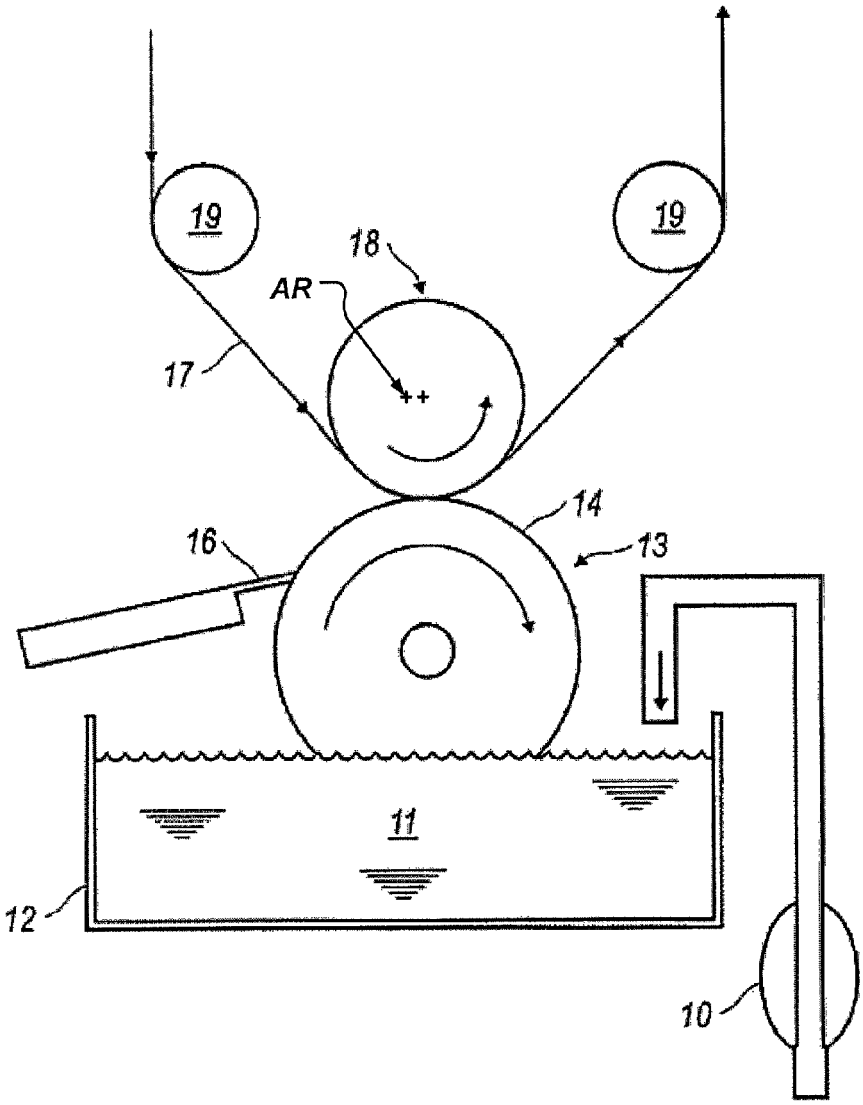
FIG. 1 is a schematic drawing of a first printing process of the invention.

In a rotogravure process (FIG. 1), a pump 10 can be used to deliver ink 11 to an ink bath 12. As a structured and/or textured drum or roller 13 passes through the bath 12, the ink 11 is transferred to a surface 14 of the roller 13. Because the surface 14 has depressions or pits (not shown) therein, the ink 11 is transferred to both the surface 14 of the roller 13 and the pits. A doctor blade 16 wipes the ink 11 off of the surface 14, such that the remaining ink 11 is present inside the pits. While a doctor blade is shown any means or method of removing ink from surface 14 known in the art may be used. As a substrate 17 is brought into contact with the roller 13, more specifically the pits, the ink 11 contained therein, is transferred to the substrate 17. Preferably, the substrate 17 is pressed against the roller 13 by a backer roller 18. Alternatively, a transfer rotogravure process can be employed where the ink is transfer from the roller to a transfer roller and then to the substrate.

In one embodiment of the present invention, immiscible or partially immiscible inks are used. Colors in rotogravure printing are typically formulated by combining several component colors until the desired color is achieved. The components are formulated to completely combine to achieve a homogeneous color. Formulating the component colors to be immiscible or partially immiscible upon combination rather than homogeneous upon combination will result in variation of color within a single print cylinder for greater design variability. A variation of this concept would be to combine a "glazing" type material to create variation in the intensity of the print within a single station. Combining these two concepts would provide a third method of print variation. These concepts could be utilized in one or more print stages in a design.

In accordance with this embodiment, when the roller 13 passes through the ink 12, the surface 14 picks up the heterogeneous ink 11 to produce a variable image, depending upon the composition of the sample of the ink 11 picked up by the surface 14. In simpler terms, should the surface 14 pick up, two units of yellow ink and one unit of red ink, the resulting composite color, when transferred to the substrate 17 will be "yellow-er" than had the surface 14 picked up only one unit of yellow ink and two units of red ink (which would produce a "redder" color). Depending upon the relative volumes of each of the inks, the degree of differentiation can be controlled. It is also within the scope of the invention to use miscible inks, wherein one or more of the miscible inks are contained in capsules (known as "microballoons"), which burst under pressure, Thus, the individual colors are maintained separate and the ink 11 maintained heterogeneous until the image is actually formed. For example, the individual inks can be joined or mated by the pressure applied by the backer roller against the substrate or, e.g., if the inks are contained in microballoons, bursting the balloons with pressure, a magnetic field or electrical charge, will release the inks from the microballoons.

It is preferable that the composition of the ink 11 vary through the ink bath 12, In other words, even if the various inks are maintained separate, advantages are realized if the various inks are dissimilarly distributed throughout the bath 12. As a result, every time the surface 14 passes through the ink bath 12, different combinations of colors can be realized. In one embodiment, this is accomplished by causing the pump 10 to forcibly introduce the ink 11 into the ink bath 12 to create variable flow, such as varied laminar flow or turbulent flow therein. The flow can cause internal uneven mixing of the immiscible colors. Due to the unpredictable nature of such flows, the result would be significant differences in the resulting mixtures.

In another embodiment, the various colors can be of different densities, creating a gradient as the level of ink 11 decreases in the ink bath 12. In other words, if two inks of different densities are both provided in the bath 12, the denser ink will settle closer to the bottom of the bath 12, while tile less dense ink will "float" toward the top of the bath 12. In a further embodiment, the various inks can be of different viscosities.

In a still further embodiment, the various inks can be formed as having differing magnetic or electrical charges. As a result, when a magnetic or electrical field is applied to the bath 12, the different inks will automatically arrange according to their charges. By alternating or varying the magnetic or electrical charge as the surface 14 moves through the bath 12, different ratios of ink will be picked up as the different inks will be moving there through. Additionally, a static electrical/magnetic field can be used to create a gradient with different reacting inks, similar to the different densities as described herein.

Prior to application of any inks, the substrate can be pretreated. Such pretreating can include, in addition to providing the background and/or primer layers, modifying the smoothness of the surface (e.g., either sanding to smooth or "roughening"). In one embodiment, where the inks include one or more lacquers, it is within the scope of the invention to provide the substrate with a lacquer repellant in localized areas as described by U.S. Pat. No. 6,991,830 and published Swedish Patent Appl. No. 9904781 (each of which is incorporated by reference in its entirety).

Contact pressure in printing can be used to create different color transfer characteristics. By varying contact pressures, color intensity can be varied. Varied contact pressures can be formed by, e.g., eccentric bearings on rolls. For example, the roller 13, a doctor roll 16, and/or the backer roller 18 can each have a non-circular rotation. This eccentric rotation can be produced by providing the specific roller with a non-circular surface, or by placing its axis of rotation AR off-center. Additionally, the axis upon which the roller rotates can be provided in a regular or irregularly shaped void in the center of the roller, such that different pressures could be provided by having the axle upon which the roller rotates move through the void. Even further the position of the axis of rotation can be varied by physically moving the axis in channels or by means of cams to change the position of the axis relative to the work to be printed.

Contact pressures can also be adjusted by varying tension applied to the substrate 17. This can be accomplished by adjusting properties of tension rollers 19. By increasing or decreasing the number/position/size/rotational velocity of each of the tension rollers 19, either independently or in coordination, the tension imparted to the substrate 17 can be variable, For example, if tension rollers 19 were placed on independent adjustable sides (which slides can move in a horizontal and/or vertical direction), when the distance between the tension rollers 19 is increased, the tension in the substrate would increase. If tile tension rollers 19 were rotated on eccentric axes or provided with eccentric bearings, even greater variability can be produced.

The contact pressures can also be controlled or differentiated with variable-controlled mechanical force application systems. Suitable application systems include screw mechanisms, pneumatics, hydraulics and electrically driven systems. Such application systems can be positioned to apply pressures to the various parts of a printing apparatus.

Design variation can also be formed by utilizing interchangeable base coat cylinders. Overall design, even in the case of a design synchronized, i.e., in registration with (often referred to as "embossed in register"), texture, may be used with different width base coats, e.g., 2"-6", specifically, 3" or 5" wide base coats, thereby providing a significantly different effect. In such embodiments, the base coat (or primer layer) is often applied to the substrate to function as a background or to pre-treat the surface substrate, e.g., to seal the substrate, such that the design can be applied. By providing the substrate with varying base coats across the width of the substrate, the final design will also differ. The type and degree of difference in effect will depend upon the type of different base coat rollers used, the surface smoothness of the substrate and/or the base coat, e.g. sanding only a portion of the substrate/base coat or sanding to a different degree of smoothness, e.g. using sandpaper of different grit sizes on different portions of the substrate/base coat.

Figure 2A:
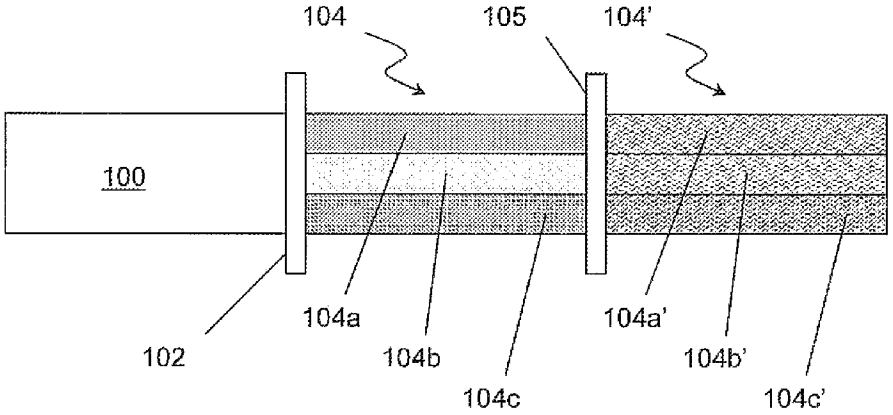
FIGS. 2*a* and 2*b* are each embodiments of an apparatus adapted to utilize the printing process of the invention.

FIG. 2*a* is a schematic of an embodiment of a printer 100. Printer 100 includes a pattern roller 102 and a texture roller 105. While Applicants uses the term "texture," it should be understood that texture need not be relief, i.e. "texture" may be a visual effect with or without a physical effect. As the substrate passes pattern roller 102 a pattern 104 is applied to the substrate. Pattern 104 may consist of three different sub-patterns 104*a*, 104*b*, and 104*c*. Sub-patterns 104*a*, 104*b*, and 104*c* may be formed from immiscible or partially immiscible inks, inks containing capsules, by using a "glazing" type material or any other method know in the art of applying different patterns.

Pattern 104 may be a wood-like pattern, where each sub-pattern 104*a*, 104*b*, and 104*c* represents another wood plank. Alternatively, pattern 104 may be a tile-like pattern where sub-patterns 104*a* and 104*c* represent tiles and sub-pattern 104*b* represents grout. Alternatively, pattern 104 may be a marble-like pattern where each sub-pattern 104*a*, 104*b*, and 104*c* represents different aspects of the marble. Pattern 104 is not limited to tile above described patterns and may be of any pattern desired. While Applicants uses the term "pattern," it should be understood that the design need not be a recurring, regular pattern, but may instead be random, like a series of pebbles each being different shape, size, texture, and/or color from any other pebble of the "pattern." Furthermore, while pattern 104 is depicted as consisting of three, equal-width sub-patterns 104*a*, 104*b*, and 104*c*, sub-patterns 104*a*, 104*b*, and 104*c* can be of any width.

As the substrate passes texture roller 105, a texture 104' is applied to the substrate. Texture 104' may comprise three sub-textures 104*a*', 104*b*', and 104*c*'. Sub-textures 104*a*', 104*b*' and 104*c*' may all be of the same texture, each of a different texture, or any combination thereof. Sub-textures 104*a*', 104*b*', and 104*c*' may each be in register with sub-patterns 104*a*, 104*b*, and 104*c*, respectively. Alternatively, sub-textures 104*a*', 104*b*', and 104*d* may be independent or sub-patterns 104*a*, 104*b*, and 104*c*.

Figure 2B:
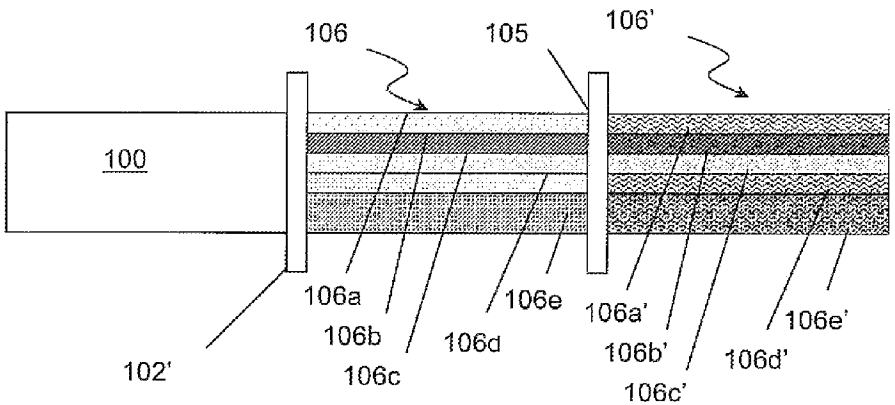

FIG. 2*b* is another embodiment of printer 100. In this embodiment as the substrate passes pattern roller 102', pattern 106, comprising five sub-patterns 106*a*-106*e* is applied to the substrate. While pattern 104 in FIG. 2*a* and pattern 106 in FIG. 2*b* are shown with three and five sub-patterns respectively, any number of sub-patterns in these embodiments can be used.

As with FIG. 2*a* above, texture 106*a*, comprising sub-textures 106*a*', 106*b*', 106*c*', 106*d*', 106*e*', which may be the same or different, may be each be in register with sub-patterns 106*a*, 106*b*, 106*c*, 106*d*, 106*e* or, alternatively, sub-textures 106*a*', 106*b*', 106*c*', 106*d*', 106*e*' may be independent of sub-patterns 106*a*, 106*b*, 106*c*, 106*d*, 106*e*, respectively.

Figure 3:
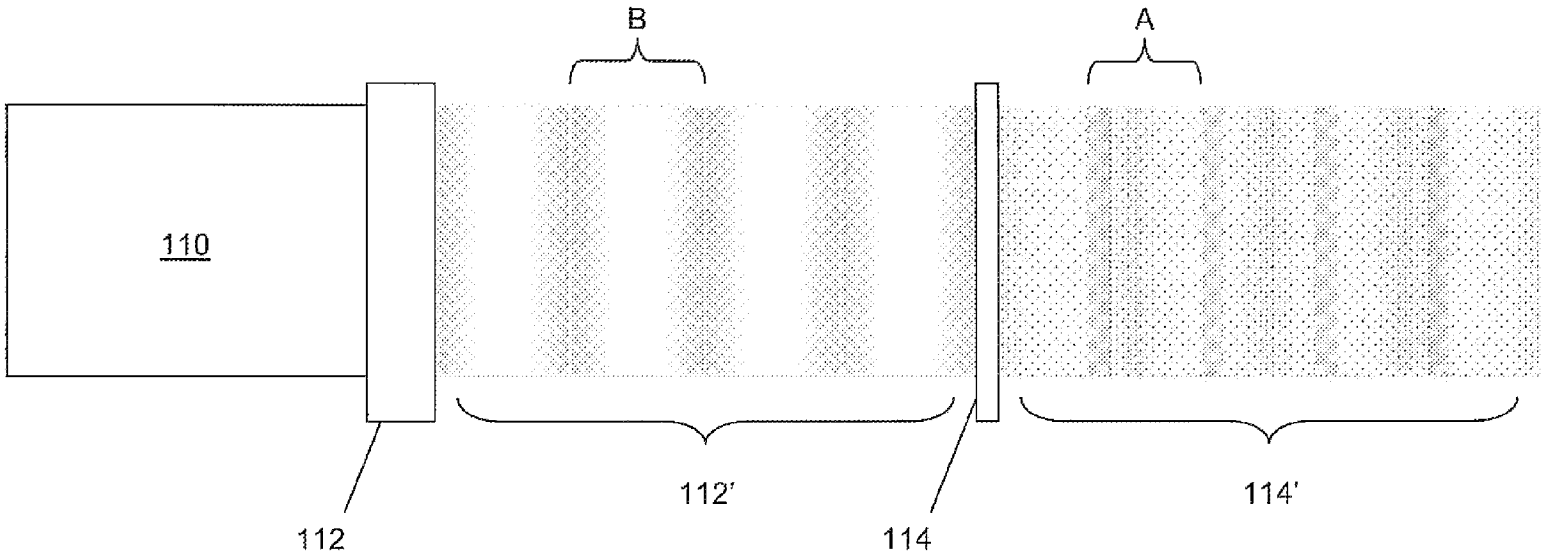
FIG. 3 is an embodiment of an apparatus adapted to utilize the printing process of the invention, where the printing roller is of a different circumference than the texture roller.

FIG. 3 is another embodiment of a printer 110. Printer 110 may have a pattern roller 112 that has a larger circumference than texture roller 114. As the substrate passes pattern roller 112, pattern 112' is applied to the substrate. Based on the circumference of pattern roller 112, the pattern will repeat every B lengths. Additionally, as the substrate passes texture roller 114, texture 114' is applied to the substrate. Based on the circumference of texture roller 114, the texture will repeat every A lengths. Preferably, A and B are neither equal nor multiples of each other. In certain embodiments, B may be bigger than A, as shown, while in other embodiments, A may be bigger than B.

Although not limited to any particular substrate, the preferred substrate of the invention is to be incorporated into a flooring system. In one embodiment, the substrate Is paper (with or without hard particles—e.g., having a Moh's hardness of at least about 4 to 6, preferably at least about 7, therein, which can be alpha-aluminum (alumina), silicon carbide, diamond, cerium oxide, zirconium oxide, and/or glass beads), and once printed, is impregnated with a thermosetting resin. The impregnated paper is then further combined with other layers and elements to form a laminate which can be bonded to a core material.

Suitable core materials include one or more of wood based material, such as wood, fiberboard such as high density fiberboard (HDF) or medium density fiberboard (MDF), veneers, such as plywood, oriented strand board, cores made from particles (including discrete pieces of polymer or wood, which can be in the form of chips, cuffs, flakes, sawdust, shavings, slivers, stands, wafers, wood flour, wood wool and/or fibers), polymer (thermosetting and/or thermoplastic), flaxboard, stone (e.g., ceramic, marble, slate), cardboard, concrete, gypsum, high density fiber reinforced plaster, and other structural materials, such as metals (e.g., brass, aluminum, steel, copper, composites, composites or alloys). In some embodiments, the core material can be foamed (either open cell or closed cell), such as polyurethane. In still further embodiments, the core is made as a composite from multiple materials (such as those listed above), either as a heterogeneous mass, multiple layers or defined sections, e.g., upper and lower veneers covering a core of particles. Any of the above materials may also be provided with antistatic or antibacterial properties, e.g., by the inclusion of silver flakes, powders or particles, carbon black, ceramics, organic compounds or other metals or alloys. Preferred plastics include extrudable and/or moldable thermosetting and/or thermoplastic resins, the latter including high density olefins and polyvinylchloride.

This laminate may also be covered with other types of coverings, such as foils (such as metal, paper or thermoplastic foils), paints, lacquers, or a variety of other decorative elements, including, but not limited to wood veneer, ceramic, metal, vinyl or other decorative materials.

In another embodiment, the substrate is the core material itself, i.e., without the paper layer, e.g., as described by, e.g., U.S. Pat. No. 6,465,046 (herein incorporated by reference in its entirety). In one embodiment, the core is optionally provided with a primer and/or a base color, on which the decorative pattern or display is printed or otherwise generated. While the term "pattern" is used herein, it is to be understood that "pattern" need not be or include any repeating units, thus "pattern" is simply a visual and/or textual display. Once the decor is complete, the printed decor can be covered with a wear layer, thereby giving the decor abrasion and/or scratch resistance. The wear layer can be provided in the form of a sheet of alpha-cellulose which is bonded to the core, loose cellulosic fibers in a polymer vehicle, or it can be applied in a liquid form, and is typically provided with hard particles as described herein. The wear layer can include melamine-formaldehyde, urea-formaldehyde, maleamid, lacquers, acrylic resins, and/or urethanes; a thermoplastic material, especially isomer thermoplastics sold under the trademark SURLYN.

Often, the result of the printing process of the invention resembles a natural or synthetic object, such as wood or wood tiles or boards, ceramic (e.g., tiles), stone (including marble and granite, such as tiles), or fantasy patterns (i.e., those not found in nature), including a monochromatic or random field.

The resulting products typically have a durability rating. As defined by the European Producers of Laminate Flooring, such products can have an abrasion resistance rating of anywhere from AC1 to AC5. Typical abrasion resistances are >300 cycles, >400 cycles, >500 cycles, at least 900 cycles (AC1), at least 1800 cycles (AC2), at least 2500 cycles (AC3), at least 4000 cycles (AC4) and at least 6500 cycles (AC5), as measured by European Standard EN 13329 (Annex E). Typical products according to the invention can also have impact resistance ratings of IC1, IC2 or IC3, as measured by European Standard EN 13329.

Moreover, the operation of the various rollers of the invention (or a subsequent device) can provide the printed image with a texture which enhances the pattern of the underlying printed image. Such texturing can be created to be "in register," or in registration, with, offset from, or to contrast with the image of the paper sheet. Such texturing maybe created by physical pressing, e.g., embossing (as taught by U.S. application Ser. No. 10/440,317 (filed May 19, 2003), U.S. Pat. No. 7,003,364, and WO9731775 and WO9731776) or chemically created (as taught by U.S. Pat. No. 6,991,830). The texture can be selected by the installer to enhance (e.g., match or contrast with) any texture of adjacent or included surfaces. The texture may also be provided on the decor such that features of the texture extend from a flooring element onto and possible completely across the adjacent flooring elements, which texture may, or may not coincide with the underlying decor. Each of the documents discussed in this paragraph are incorporated herein in its entirety.

When the substrate is a core material, the substrate can be of any regular or irregular geometric shape, e.g., circular, curved, octagonal, hexagonal, triangular. When the substrate is rectangular (e.g., with one set of long sides and one set of short sides), the long sides are usually provided with joining elements permitting joining to another article by relative horizontal movement, relative rotational movement or relative vertical movement or a fold down movement, such as shown in the disclosure of WO 2006/043893 and U.S. Pat. Nos. 6,854,235 and 6,763,643 and U.S. Pat. Appl. Pub. No. 2007/0006543, especially the drawings thereof (each of which is hereby incorporated by reference in its entirety). Such relative horizontal movement can be a sliding motion along aside, joining only one entire side at once, or joining, multiple sides at once, as shown in FIGS. 4-7 of U.S. Pat. No. 6,823,638 (incorporated by reference in its entirety). The short sides of such substrates can also be, but need not, assembleable by relative horizontal movement and may lock. The joints can include a slideable or deformable element, such as a metal or plastic spring or clip, or in an alternative, a static element to hold the panels together once assembled.

The substrates and products made from such substrates of the invention are typically used in the construction of a surface, such as a top for a counter or table, floor, ceiling, or wall. Such surfaces are often found in residential structures (e.g., single and multi-family houses, condominiums, townhomes, cooperatives, apartments, and lobbies of such buildings), commercial structures (e.g., retail stores, strip malls, shopping malls, office buildings, hotels, restaurants, supermarkets, banks, churches, airports and other transit stations). Public structures (e.g., stadiums and arenas, schools, museums, theaters, post offices, hospitals, courthouses and other government buildings), as well as industrial structures (e.g., manufacturing plants, mills, and warehouses) and surfaces of vehicles (e.g., ships, trains, aircraft, public and private busses, cars and other motor vehicles).

It should be apparent that embodiments other than those specifically described above may come within the spirit and scope of the present invention. Hence, the present invention is not limited by the above description.

The invention claimed is:

1. A method for printing a variable wood pattern design on a substrate, comprising:

(a) applying a plurality of patterns to a substrate via a single design roller to produce a coated substrate, wherein the plurality of patterns comprise wood patterns, wherein the wood patterns are longitudinal wood patterns defined by a width and a length dimension, wherein the length dimension extends transversely to a direction of the application to the substrate via single design roller; and (b) applying a texture to the coated substrate via a downstream texture roller;

wherein the single design roller and the downstream texture roller are of different diameters, and a diameter of the downstream texture roller and a diameter of the single design roller are non-multiples of each other.

2. The method of claim 1, wherein the plurality of patterns is repeated more often than the texture.

3. The method of claim 1, wherein the texture is repeated more often than the plurality of patterns.

4. The method of claim 1, wherein the texture applied to the coated substrate is one of a single texture and a plurality of textures.

5. The method of claim 1, wherein the texture applied to the coated substrate is in register with the plurality of patterns applied to the substrate.

6. The method of claim 1, further comprising varying a contact pressure between the substrate and at least one of the single design roller and the downstream texture roller by using at least one of a roller against which the substrate is pressed and a backer roll that presses the substrate against a roller that has a non-circular surface or an off-center axis of rotation.

7. The method of claim 1, wherein applying a plurality of patterns to a substrate comprises positioning the single design roller in communication with the substrate; and wherein applying a texture to the coated substrate comprises positioning the downstream texture roller in communication with the coated substrate.

* * * * *